US007604139B1

(12) United States Patent
Long, Jr.

(10) Patent No.: US 7,604,139 B1
(45) Date of Patent: Oct. 20, 2009

(54) RESEALABLE, TAMPER EVIDENT CLOSURE

(75) Inventor: Charles J. Long, Jr., New Castle, PA (US)

(73) Assignee: International Plastics and Equipment Corporation, New Castle, PA (US)

( * ) Notice: Subject to any disclaimer, the term of this patent is extended or adjusted under 35 U.S.C. 154(b) by 483 days.

(21) Appl. No.: 11/104,991

(22) Filed: Apr. 13, 2005

(51) Int. Cl.
*B65D 41/32* (2006.01)
*B65D 17/32* (2006.01)

(52) U.S. Cl. ..... 215/256; 215/254; 220/268; 220/270; 222/253.07

(58) Field of Classification Search ..... 215/253, 215/254, 256; 220/269, 270, 276, 268; 222/156.07, 222/15.073
See application file for complete search history.

(56) References Cited

U.S. PATENT DOCUMENTS 906,875 A * 12/1908 Hammer ..... 215/254
3,933,264 A * 1/1976 Rossi ..... 215/254
4,006,839 A * 2/1977 Thiel et al. ..... 220/266
4,026,459 A * 5/1977 Blanchard ..... 229/404
4,202,455 A 5/1980 Faulstich
4,281,774 A * 8/1981 Mumford ..... 220/270
4,385,708 A 5/1983 Curry
4,522,308 A 6/1985 Sullivan
4,531,650 A * 7/1985 Friendship ..... 215/256
4,540,098 A * 9/1985 Luker ..... 215/216
4,565,293 A 1/1986 Jonas
4,577,771 A 3/1986 Martinez
4,593,830 A 6/1986 Bullock
4,660,735 A 4/1987 Peschardt et al.
4,676,389 A 6/1987 Bullock
4,691,834 A 9/1987 Bullock, III
4,721,210 A * 1/1988 Lawrence et al. ..... 206/459.1
4,798,301 A * 1/1989 Bullock et al. ..... 215/256
4,844,268 A 7/1989 Bullock, III
4,934,546 A * 6/1990 Markley ..... 215/256
4,967,920 A 11/1990 Dahl
5,248,050 A 9/1993 Janousch et al.
5,853,095 A 12/1998 Marshall et al.

* cited by examiner

*Primary Examiner*—Robin Hylton
(74) *Attorney, Agent, or Firm*—Eckert Seamans Cherin & Mellot, LLC; Carol A. Marmo, Esq.

(57) ABSTRACT

A tamper evident closure for a container having a bead provided on the outside surface of the neck thereof. The closure includes a top section and an outer skirt extending downwardly from the top section. The outer skirt includes a tamper evident strip extending along only a portion of the outer perimeter. The tamper evident strip is connected to a remaining portion of the outer skirt by a tear membrane, wherein the tamper evident strip may be separated from the remaining portion along the tear membrane. A first lug is provided at least partially on an inner surface of the temper evident strip and one or more second lugs are provided on an inner surface of the remaining portion of the outer skirt. The first lug and the one or more second lugs are each adapted to engage the bead on container to secure the closure to the container.

13 Claims, 6 Drawing Sheets

RESEALABLE, TAMPER EVIDENT CLOSURE

BACKGROUND OF THE INVENTION

1. Field of the Invention

The present invention relates to a closure for a container such as a bottle, and more particularly, to a resealable, tamper evident closure for a container such as a bottle.

2. Description of the Related Art

The use of tamper evident or indicating closures has become quite common, particularly in connection with the packaging of consumer products such as food and beverage products. The tamper evident nature of the closure provides a level of confidence to consumer that the product they have purchased has not been previously opened or tampered with. Several temper evident closure structures are known in the art.

For example, U.S. Pat. No. 4,844,268 to Bullock, III describes a plastic cap for a container that has a top disk, an upper skirt extending downwardly from the top disk, and a lower skirt extending downwardly from the upper skirt. The upper and lower skirts are joined by a line of minimum thickness that extends around the entire circumference of the cap. Both the upper skirt and the lower skirt are provided with locking beads formed in three separate sections around the inner circumference of the respective skirt. The locking beads are designed to engage corresponding beads provided on the container. In order to remove the cap from the container, a user pulls a tear tab provided on the lower skirt and separates the lower skirt from the upper skirt along the line of minimum thickness.

U.S. Pat. No. 4,967,920 to Dahl describes a closure for a container that includes an end panel and a skirt depending downwardly therefrom. The skirt includes a lower band having a notch in which a tamper indicating member is provided. The tamper indicating member is attached to the skirt by axial bridges and to the lower band of the skirt by circumferential bridges. The tamper indicating member is provided with a bead on the internal surface thereof that engages a bead provided on the container to which the closure is attached so as to interlock the tamper indicating member with the container. The lower band does not include a locking bead and does not interlock with the container. The bridges may all rupture when the closure is removed from the container with the tamper indicating member dropping out and leaving a readily observable notch in the band. Alternatively, one of the circumferential extending bridges may be made of sufficient strength so that the tamper indicating member remains attached to the closure, but its rupture from the remainder of the closure is obvious.

U.S. Pat. No. 5,248,050 to Janousch et al. describes a tamper-evident screw cap for a bottle that includes a lower guarantee strip having a predetermined breakage point at which the guarantee strip is able to be separated though its entire width. The predetermined breakage point includes at least two ribs that connect the ends of the guarantee strip across a separation space. A window-shaped stress relief aperture is arranged near the predetermined breakage point to improve the expandability of the guarantee strip when the cap is being screwed on to the bottle for the first time. In this instance, the stress relief aperture prevents the forces caused by the circumferential expansion of the guarantee strip from breaking the predetermined breakage point. When screwing the cap off for the first time, a flow of forces is created in the guarantee strip such that the stress relief aperture is no longer effective and the guarantee strip fulfills its function by tearing or otherwise separating from the cap to indicate that the cap has been removed. The portion of the guarantee strip that separates from the cap includes a retention element in the form of a bead that engages a corresponding bead on the bottle. The portion of the guarantee strip that is not separated from the cap does not include a similar bead. The upper portion of the cap includes threads for screwing the cap onto the bottle.

While the above described container closures may be effective for particular applications, there is room for improvement in the field of resealable, tamper evident container closures.

SUMMARY OF THE INVENTION

The present invention relates to a tamper evident closure for a container such as a bottle containing a liquid, wherein the container has a bead provided on the outside surface of the neck of the container. The closure includes a top section and an outer skirt extending downwardly from the top section. The outer skirt includes a tamper evident strip extending along only a portion of the outer perimeter. The tamper evident strip is connected to a remaining portion of the outer skirt by a tear membrane, wherein the tamper evident strip may be separated from the remaining portion along the tear membrane. A first lug is provided at least partially on an inner surface of the temper evident strip and one or more second lugs are provided on an inner surface of the remaining portion of the outer skirt. The first lug and the one or more second lugs are each adapted to engage the bead on the outside surface of the neck of the container to secure the closure to the container. When the tamper evident strip is separated from the remaining portion, it is an indication that the container has been opened. Also, the closure, without the tamper evident strip, may be re-secured to the container by way of the remaining lugs. The closure may also include a valve or plug extending downwardly from the top section. In such a case, the valve is located within the outer perimeter of the outer skirt.

In one embodiment, the entirety of the first lug is provided on the inner surface of the tamper evident strip such that it is completely separated along with the tamper evident strip. In another embodiment, at least a first portion of the first lug is provided on the inner surface of the temper evident strip, and a second portion of the first lug is provided on the inner surface of said remaining portion.

The top section of the closure may be circular, and the valve, if provided, and the outer skirt may be circumferential in nature. In addition, the valve may have a first height and the outer skirt may have a second height that is greater than the first height. In the preferred embodiment, the tamper evident strip extends along approximately one third of the outer perimeter of the outer skirt. Also, the one or more second lugs are preferably two lugs that are evenly spaced along the remaining portion of the outer skirt. The top portion may have an outer lip having a portion that is thicker than a remainder of the outer lip to aid in removal of the closure from the container. Preferably, the closure is a plastic material, and the tear membrane is a line of reduced thickness plastic. The tamper evident strip preferably includes a tab, such as a tab extending downwardly from tamper evident strip, to facilitate separation of the tamper evident strip.

BRIEF DESCRIPTION OF THE DRAWINGS

A further understanding of the invention can be gained from the following Description of the Preferred Embodiments when read in conjunction with the accompanying drawings in which:

FIGS. 6 and 7 are bottom plan views of the closure of FIG. 1 attached to container (the container is shown in cross-section), wherein FIG. 6 shows the tamper evident strip partially separated from the remainder of the outer skirt of the closure, and FIG. 7 shows the tamper evident strip completely separated from the remainder of the outer skirt of the closure.

Similar numerals refer to similar parts throughout the specification.

DESCRIPTION OF THE PREFERRED EMBODIMENTS

Figure 1:
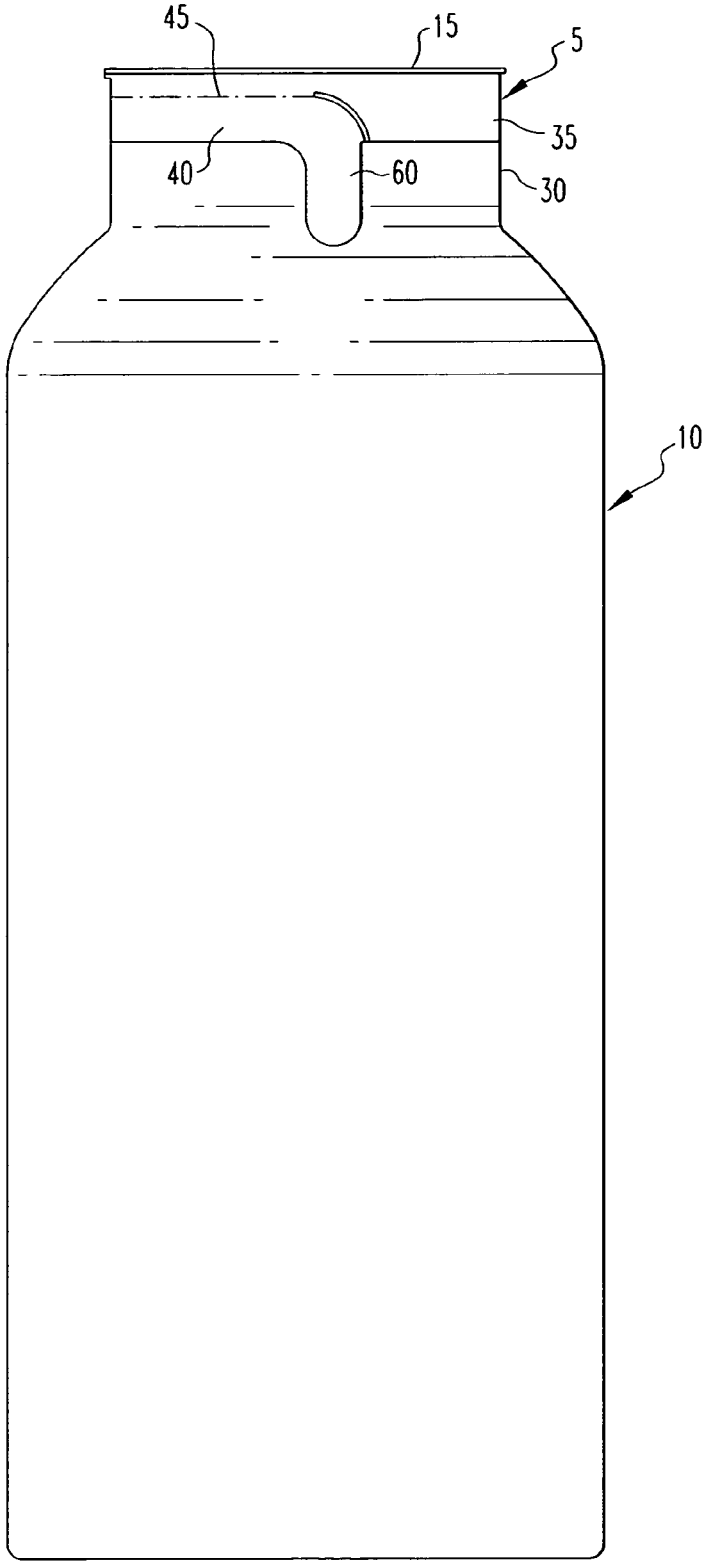
FIG. 1 is a side elevational view of a closure attached to a container according to one embodiment of the present invention.
Figure 2:
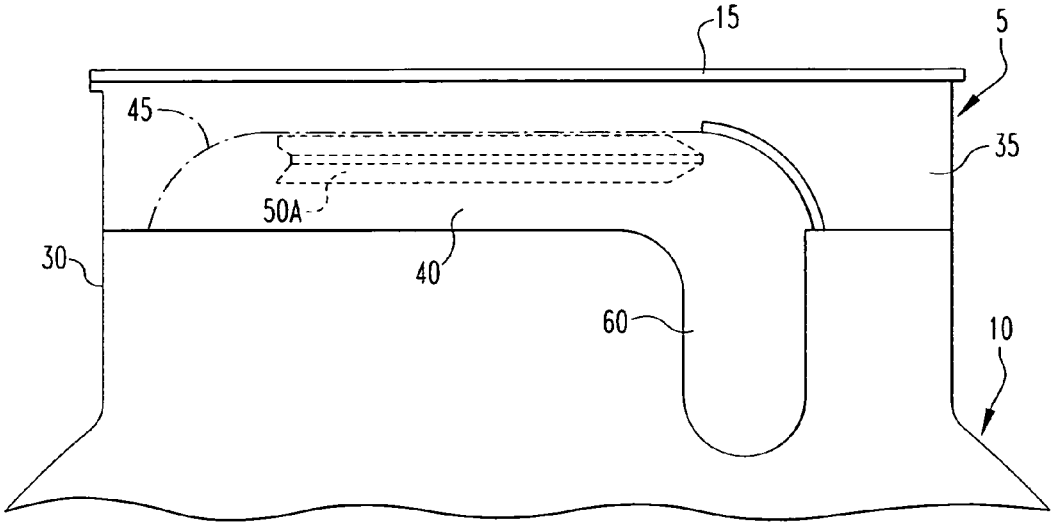
FIG. 2 is a view of an enlarged portion of FIG. 1, namely an upper portion of the container including the closure.
Figure 3:
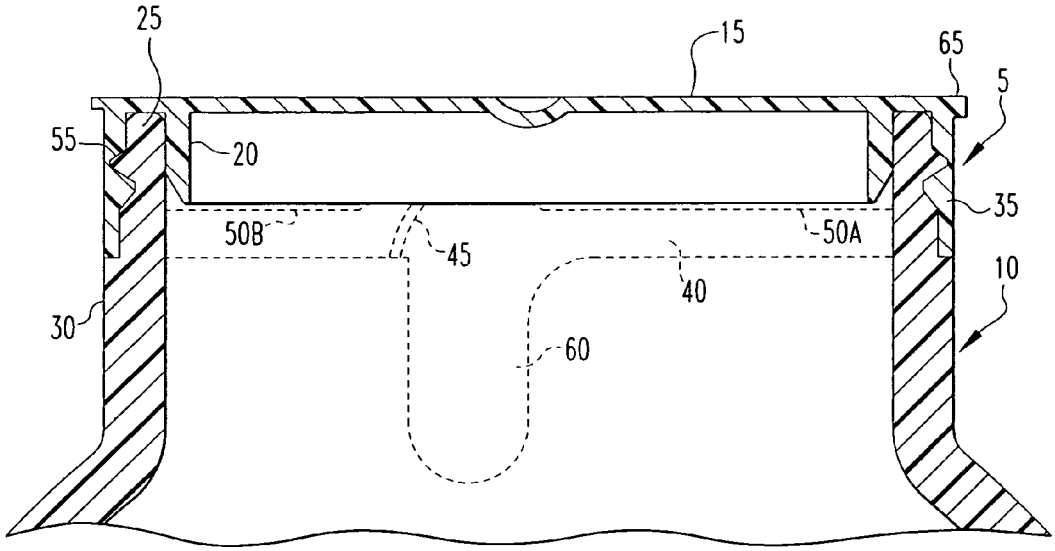
FIG. 3 is a cross-sectional view of the closure and a portion of the container shown in FIG. 1, with a portion of the closure shown in phantom lines.
Figure 4:
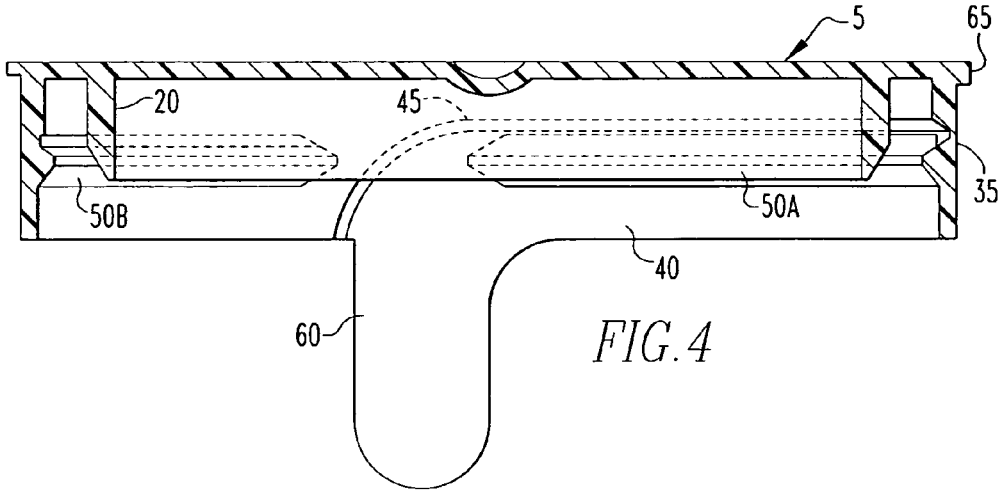
FIG. 4 is a cross-sectional view of the closure of FIG. 1 with a portion of the closure shown in phantom lines.
Figure 5:
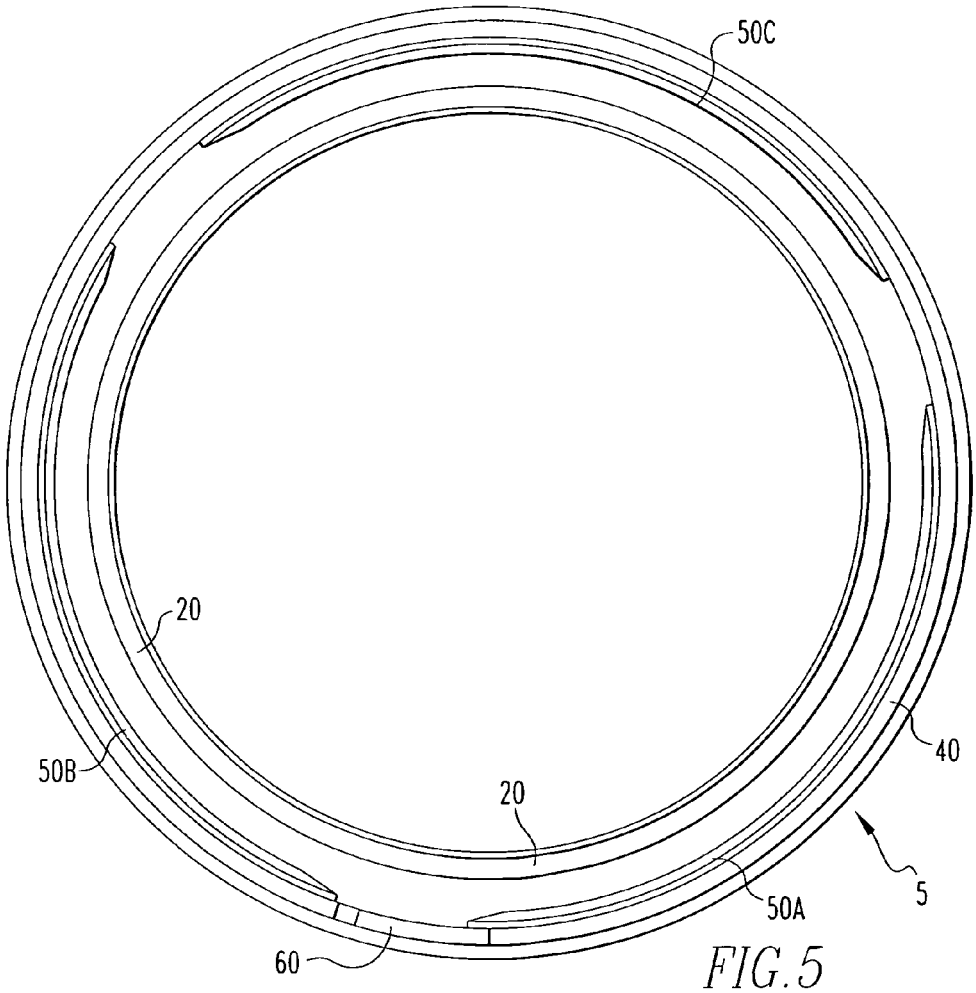
FIG. 5 is a bottom plan view of the closure of FIG. 1.

FIG. 1 is a side elevational view of a closure 5 attached to a container 10, such as a bottle containing a liquid, according to one embodiment of the present invention. The closure 5 is a tamper evident closure, preferably made of a plastic material or the like, capable of indicating that closure 5 has been removed from container 10. In addition, the closure 5 may be reattached to the container 10 to reseal container 10. FIG. 2 is a view of an enlarged portion of FIG. 1, namely an upper portion of container 10. FIG. 3 is a cross-sectional view of closure 5 and a portion of container 10, with a portion of closure 5 shown in phantom lines. Similarly, FIG. 4 is a cross-sectional view of closure 5, without container 10, with a portion of closure 5 shown in phantom lines. FIG. 5 is a bottom plan view of closure 5.

Closure 5 includes a generally flat, circular top section 15 having a circumferential inner valve or plug portion 20 (FIGS. 3 and 4) depending downwardly therefrom. The inner valve or plug portion 20 is adapted to fit inside the top lip 25 of the neck 30 of the container 10 to provide a seal. Also depending downwardly from the top section 15 and spaced outwardly from the inner valve or plug portion 20 is a circumferential outer skirt 35. Preferably, the outer skirt 35 extends downwardly from the top section 15 to a larger degree than the inner valve or plug portion 20 (i.e., the outer skirt 35 has a larger height than the inner valve or plug portion 20). In an alternative embodiment, the inner valve or plug portion 20 is omitted, and a container 10 is initially sealed, underneath closure 5, using another mechanism, such as, for example, a piece of foil or a piece of corrugated material.

The outer skirt 35 is adapted to fit around and engage the outside of the neck 30 of the container 10. The outer skirt 35 includes a removable tamper evident strip 40 that is attached to the remainder of the outer skirt 35 by a tear membrane 45 consisting of a thin membrane of plastic (thinner than the plastic forming the outer skirt 35). The tamper evident strip 40 makes up only a portion of the outer skirt 35, preferably one-third of the outer skirt 35 as seen in the Figures. In other words, the tamper evident strip extends along only a portion of, and not the entirety of, the outer perimeter of the outer skirt 35. The inside of the tamper evident strip 40 is provided with a lug 50A that extends longitudinally along a portion of the tamper evident strip 40. Similar lugs are provided on the inside of the remainder of the outer skirt 35 in substantially the same plane as lug 50A. Preferably, two such lugs 50B and 50C are provided and spaced along the remainder of the outer skirt 35 (to make a total of three lugs). The lugs 50A, 50B, 50C are each designed to engage a locking bead 55 (FIG. 3) provided around the outer circumference of the neck 30 container 10 and thereby secure the closure 5 to container 10.

Figure 6:
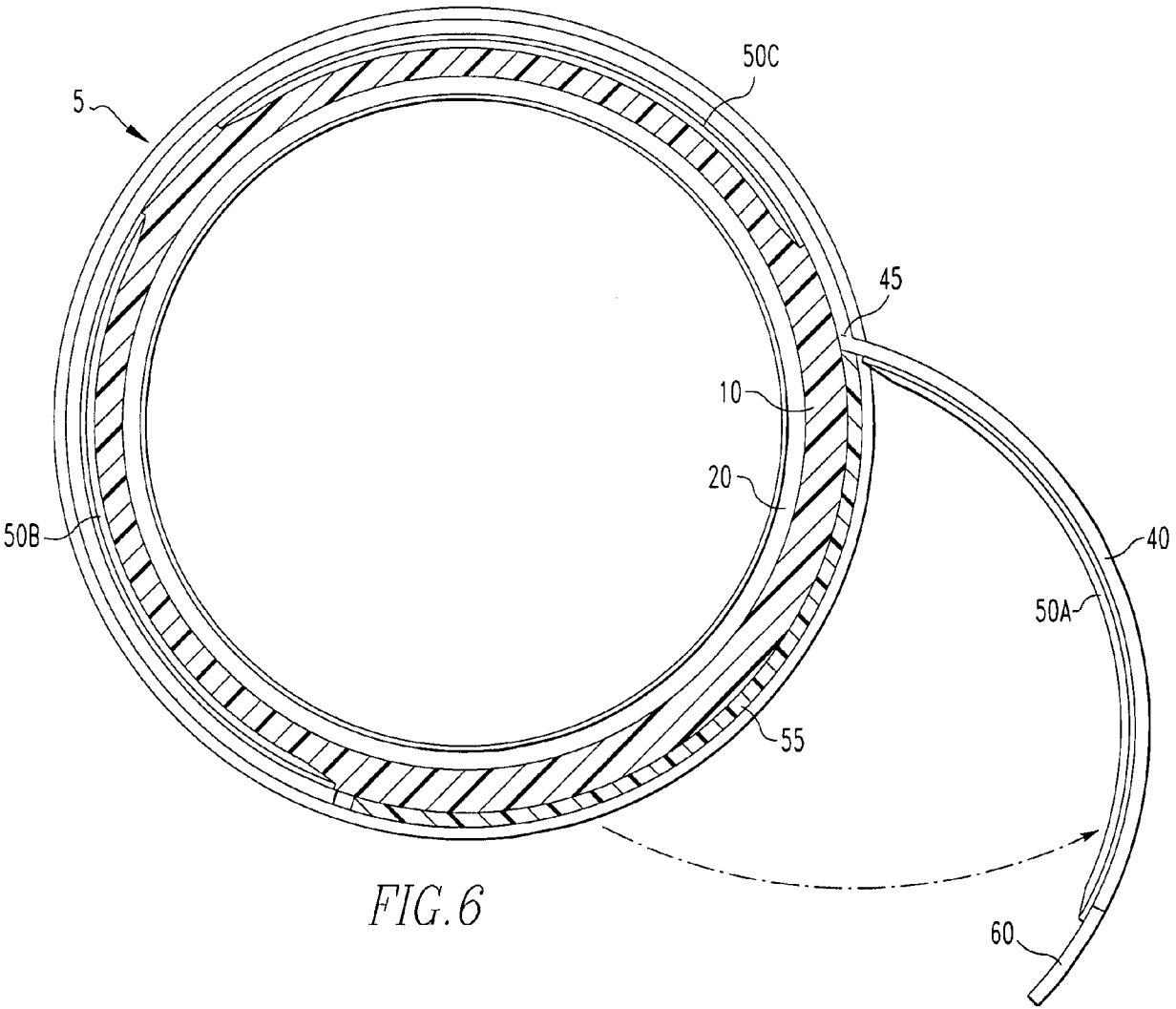
Figure 7:
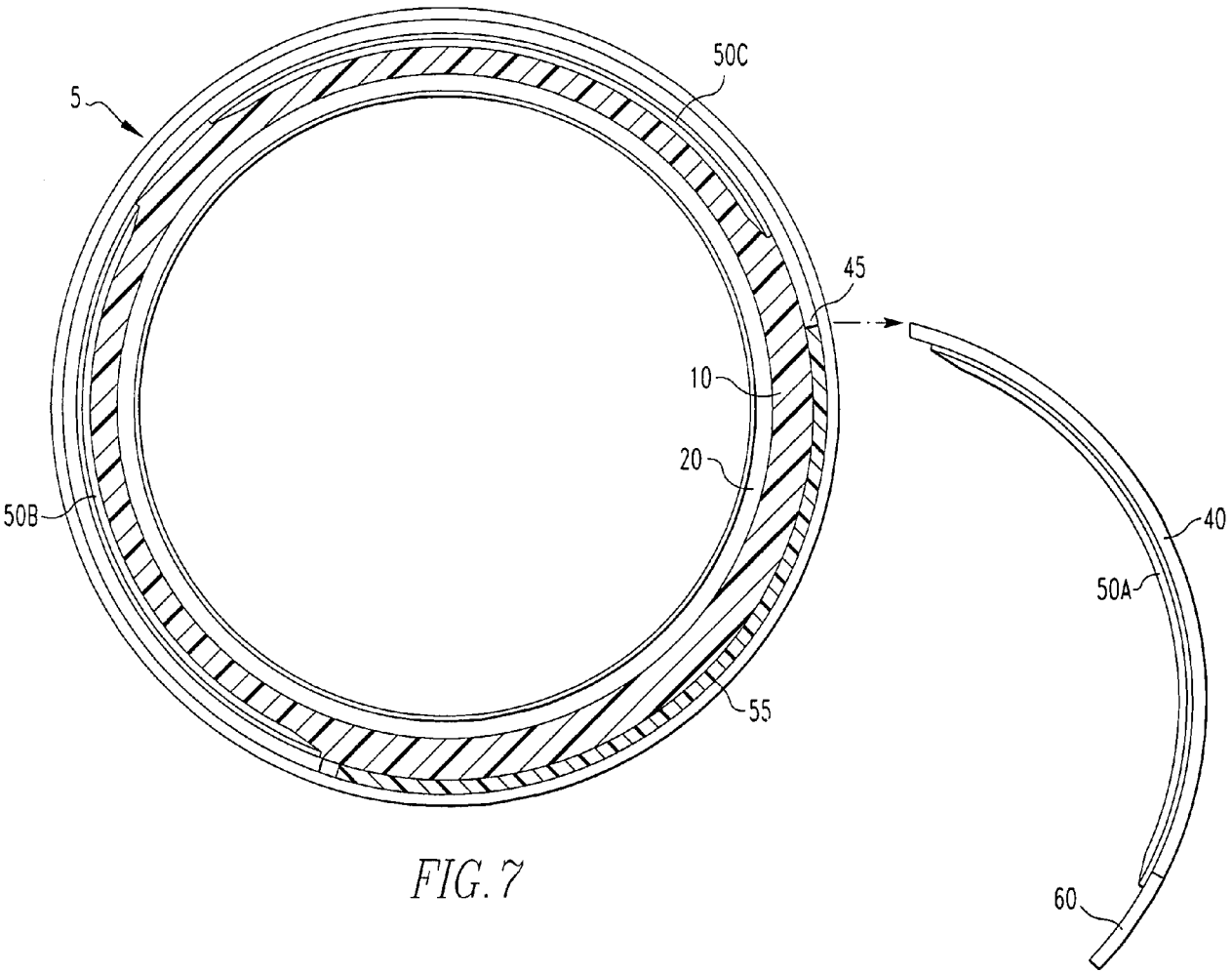

When the closure 5 is removed from the container 10 for the first time, a user grips the tamper evident strip 40 by a downwardly extending tab 60 and separates the tamper evident strip 40 completely from the remainder of the outer skirt 35 along the tear membrane 45. FIGS. 6 and 7 are bottom plan views of closure 5 attached to container 10 (container 10 is shown in cross-section), wherein FIG. 6 shows the tamper evident strip 40 partially separated from the remainder of the outer skirt 35 and FIG. 7 shows the tamper evident strip 40 completely separated from the remainder of the outer skirt 35. Once the tamper evident strip 40 has been separated from the remainder of the outer skirt 35, the closure may be taken off of the container 10 by applying a generally upward force on top section 15. In order to facilitate this process, top portion 15 is preferably provided with a thickened outer lip portion 65 (FIG. 3) adjacent to the location of the tamper evident strip 40 (i.e., thickened with respect to the remainder of the outer lip of top portion 15). The absence of the tamper evident strip 40 on closure 5 indicates that the container 10 has been previously opened and most likely that the closure 5 has been previously removed.

According to an aspect of the present invention, the closure 5 may be reattached to the container 10 after it has been removed. The closure 5 will, in such cases, be secured in place as a result of the remaining lugs 50B and 50C provided on the remaining portion of the outer skirt 35 engaging the bead 55 provided on neck 30 of container 10. When reattached in this manner, the inner valve or plug portion 20 will provide a seal by fitting inside the top lip 25 of the neck 30 of the container 10.

Figure 8:
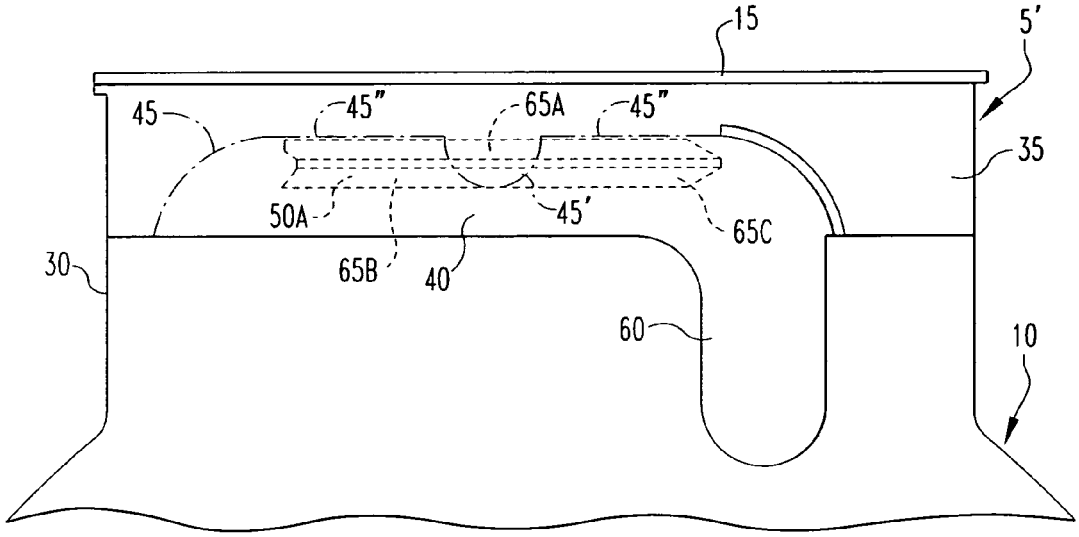
FIG. 8 is a side view of a closure attached to a container according to an alternate embodiment of the present invention.

FIG. 8 is a side view of a closure 5' attached to a container 10 according to an alternate embodiment of the present invention. As seen in FIG. 8, tear membrane 45 has a portion 45' that dips downwardly in an arc from a horizontal portion 45". Portion 45' crosses over lug 50A such that a first portion 65A of lug 50A resides on the inside of the remainder of the outer skirt 35, and second and third portions 65B and 65C of lug 50A reside on the inner surface of tamper evident strip 45. As a result, when the tamper evident strip 40 is separated from the remainder of the outer skirt 35 along the tear membrane 45 (and along portion 45'), the remainder of the outer skirt 35 will have the portion 65A thereon, which, along with lugs 50B and 50C, will facilitate reattachment of the closure 5' to the container 10 by engaging the bead 55 provided on the neck 30 of container 10.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A tamper evident closure for a container, said container having a neck having an outside surface, said outside surface having a bead, comprising:

a top section;

an outer skirt extending downwardly from said top section, said outer skirt having an outer perimeter, said outer skirt having a tamper evident strip extending along only a portion of said outer perimeter, said tamper evident strip being connected to a remaining portion of said outer skirt by a tear membrane, wherein said tamper evident strip may be separated from said remaining portion along said tear membrane; and a first lug provided at least partially on an inner surface of said tamper evident strip and one or more second lugs provided on an inner surface of said remaining portion, said first lug and said one or more second lugs each for engaging said bead, wherein at least a first portion of said first lug is provided on said inner surface of said tamper evident strip, wherein a second portion of said first lug is provided on said inner surface of said remaining portion and wherein said tear membrane extends over said first lug at least between said first portion of said first lug and said second portion of said first lug.

2. The tamper evident closure according to claim 1, wherein said first portion and a third portion of said first lug are provided on said inner surface of said tamper evident strip, said second portion of said first lug being located between said first portion and said third portion of said first lug.

3. The tamper evident closure according to claim 1, further comprising a plug extending downwardly from said top section, said plug being located within said outer perimeter of said outer skirt.

4. The tamper evident closure according to claim 3, wherein said top section is circular, and wherein said plug and said outer skirt are circumferential in nature.

5. The tamper evident closure according to claim 3, wherein said plug has a first height and said outer skirt has a second height, said second height being greater than said first height.

6. The tamper evident closure according to claim 1, wherein said tamper evident strip extends along approximately one third of said outer perimeter.

7. The tamper evident closure according to claim 2, wherein said one or more second lugs are a first second lug and a second lug.

8. The tamper evident closure according to claim 1, wherein said top section has an outer lip, a portion of said outer lip being thicker than a remainder of said outer lip.

9. The tamper evident closure according to claim 1, wherein said closure is plastic, and wherein said tear membrane is a line of reduced thickness plastic.

10. The tamper evident closure according to claim 1, wherein said first lug and said one or more second lugs are spaced evenly around the outer perimeter of said outer skirt.

11. The tamper evident closure according to claim 1, wherein said tamper evident strip includes a tab extending therefrom.

12. The tamper evident closure according to claim 1, wherein said tab is a downwardly extending tab.

13. The tamper evident closure according to claim 1, wherein said tamper evident strip is completely separated from said remaining portion along said tear membrane.

* * * * *

UNITED STATES PATENT AND TRADEMARK OFFICE

CERTIFICATE OF CORRECTION

PATENT NO. : 7,604,139 B1
APPLICATION NO. : 11/104991
DATED : October 20, 2009
INVENTOR(S) : Charles J. Long, Jr.

It is certified that error appears in the above-identified patent and that said Letters Patent is hereby corrected as shown below:

Title page, second column, under (74) Attorney, Agent, or Firm -- Eckert Seamans Cherin & Mellot, LLC should read --Eckert Seamans Cherin & Mellott, LLC--.
Front page, second column, item (57) ABSTRACT, line 10, "temper" should read --tamper--.
Column 1, line 16, "temper" should read --tamper--.
Column 2, line 34, "valve or plug" should read --plug--.
Column 2, line 35, "valve" should read --plug--.
Column 2, line 45, "valve" should read --plug--.
Column 2, line 46, "valve" should read --plug--.
Column 3, line 43, "valve" should read --plug--.
Column 3, line 45, "valve" should read --plug--.
Column 3, line 48, "valve" should read --plug--.
Column 3, line 51, "valve" should read --plug--.
Column 3, line 52, "valve" should read --plug--.
Column 3, line 53, "valve" should read --plug--.
Column 4, line 37, "valve" should read --plug--.
Column 6, line 10, "and a second lug" should read --and a second second lug--.

Signed and Sealed this

Eighth Day of June, 2010

David J. Kappos

David J. Kappos
*Director of the United States Patent and Trademark Office*